US010614783B2

(12) United States Patent
Kilpatrick et al.

(10) Patent No.: US 10,614,783 B2
(45) Date of Patent: Apr. 7, 2020

(54) PERCUSSION INSTRUMENT WITH A PLURALITY OF SOUND ZONES

(71) Applicant: INNOVA Music, LLC, Los Angeles, CA (US)

(72) Inventors: Bob Kilpatrick, Fair Oaks, CA (US); Manuel Luz, El Dorado Hills, CA (US)

(73) Assignee: INNOVA MUSIC, LLC, Los Angeles, CA (US)

( * ) Notice: Subject to any disclaimer, the term of this patent is extended or adjusted under 35 U.S.C. 154(b) by 0 days.

(21) Appl. No.: 15/873,375

(22) Filed: Jan. 17, 2018

(65) Prior Publication Data

US 2019/0221196 A1 Jul. 18, 2019

(51) Int. Cl.

| | |
|---|---|
| ***G10D 13/02*** | (2020.01) |
| ***G10H 3/14*** | (2006.01) |
| *G10G 5/00* | (2006.01) |
| *G10D 3/02* | (2006.01) |

(52) U.S. Cl.

CPC ..... *G10D 13/024* (2013.01); *G10H 3/146* (2013.01); *G10D 3/02* (2013.01); *G10G 5/005* (2013.01); *G10H 2220/155* (2013.01)

(58) Field of Classification Search

CPC . G10D 13/024; G10G 5/005; G10H 2220/155
USPC ..... 84/411 R; D17/22
See application file for complete search history.

(56) References Cited

U.S. PATENT DOCUMENTS

| | | | | |
|---|---|---|---|---|
| 5,422,955 | A * | 6/1995 | Guzman | G10D 3/00 381/118 |
| 5,461,958 | A * | 10/1995 | Dresdner | G10D 3/02 84/267 |
| 8,450,587 | B2 * | 5/2013 | McPherson | G10D 3/02 84/267 |
| D755,886 | S * | 5/2016 | Luz | D17/22 |
| 9,905,206 | B2 * | 2/2018 | Alexander | G10D 13/028 |
| 2010/0218665 | A1 * | 9/2010 | Clark | G10D 3/02 84/731 |
| 2014/0208925 | A1 * | 7/2014 | Osborne | G10H 3/146 84/725 |
| 2017/0206881 | A1 * | 7/2017 | Ekuni | G10H 3/146 |

* cited by examiner

*Primary Examiner* — Jianchun Qin
(74) *Attorney, Agent, or Firm* — Scarinci Hollenbeck, LLC; Libby Babu Varghese

(57) ABSTRACT

A percussion instrument with a plurality of sound zones comprising a main body defining an inner space containing a volume of air, the main body including an upper surface and a lower surface that are joined along their perimeters by a side wall, the upper surface including a sound hole and functioning as a soundboard, and an inner bracing attached directly to an inner face of the soundboard, the inner bracing configured to define a plurality of sound zones across the soundboard, each sound zone having a specific tonal quality related to the surface area comprising the sound zone.

11 Claims, 5 Drawing Sheets

PERCUSSION INSTRUMENT WITH A PLURALITY OF SOUND ZONES

BACKGROUND

In the world of music, the sound of drums is a critical component in the audio mix. Percussion instruments, and drum sets, in particular, are an essential part of creating a musical beat. However, there are several limitations inherent in the use of drum sets.

The drum set itself is a complicated instrument. It is made up of many different pieces which takes time to set up and take down. It requires room to transport and is bulky and heavy to move which make transportation difficult and touring expensive. Moreover, because it is a complicated instrument, it is difficult to properly microphone and amplify.

Drums in general are large and stationary instruments. A drum set takes up a good deal of room on a stage and is generally immobile during performance. This makes it difficult for a drummer to interact with either the audience or other band members. The drummer simply cannot step to the front of the stage and interact with the audience like other band members that are playing different instruments. Moreover, a drum set and other percussion instruments such as congas, cannot be easily transported to remote locations such as beaches, camping sites, or street performance locations. This limits the locations where most drum sets and percussion instruments can be effectively used.

Moreover, percussion instruments are typically loud instruments. It is difficult, if not impossible, to play a percussion instrument in a quiet environment such as a restaurant or an apartment dwelling. Many venues, including cafes and churches, do not use drum sets or heavy percussions for this very reason. Likewise, light hand percussion instruments, such as a shaker or tambourine, cannot alone play louder venues.

Other than a drum set, most all percussion instruments provide only a few similar sounds, including tambourines, congas, and triangles. There are few, if any, percussion instruments that can provide a variety of sounds such as bass, snare, and conga like sounds from a single instrument body. What is needed is a percussion instrument that is portable, easy to set up and take down, capable of generating a diverse variety of different sounds, and easily amplified in a variety of different situations.

BRIEF SUMMARY OF THE INVENTION

In an effort to address the above-identified problems, the present application discloses a percussion instrument comprising a main body defining an inner space containing a volume of air, the main body including an upper surface and a lower surface that are joined along their perimeters by a side wall, the upper surface including a sound hole and functioning as a soundboard, and an inner bracing attached directly to an inner face of the upper surface soundboard, the inner bracing configured to define a plurality of sound zones across the soundboard, each sound zone having a specific tonal quality related to the surface area comprising the sound zone.

DETAILED DESCRIPTION OF THE INVENTION

Figure 1:
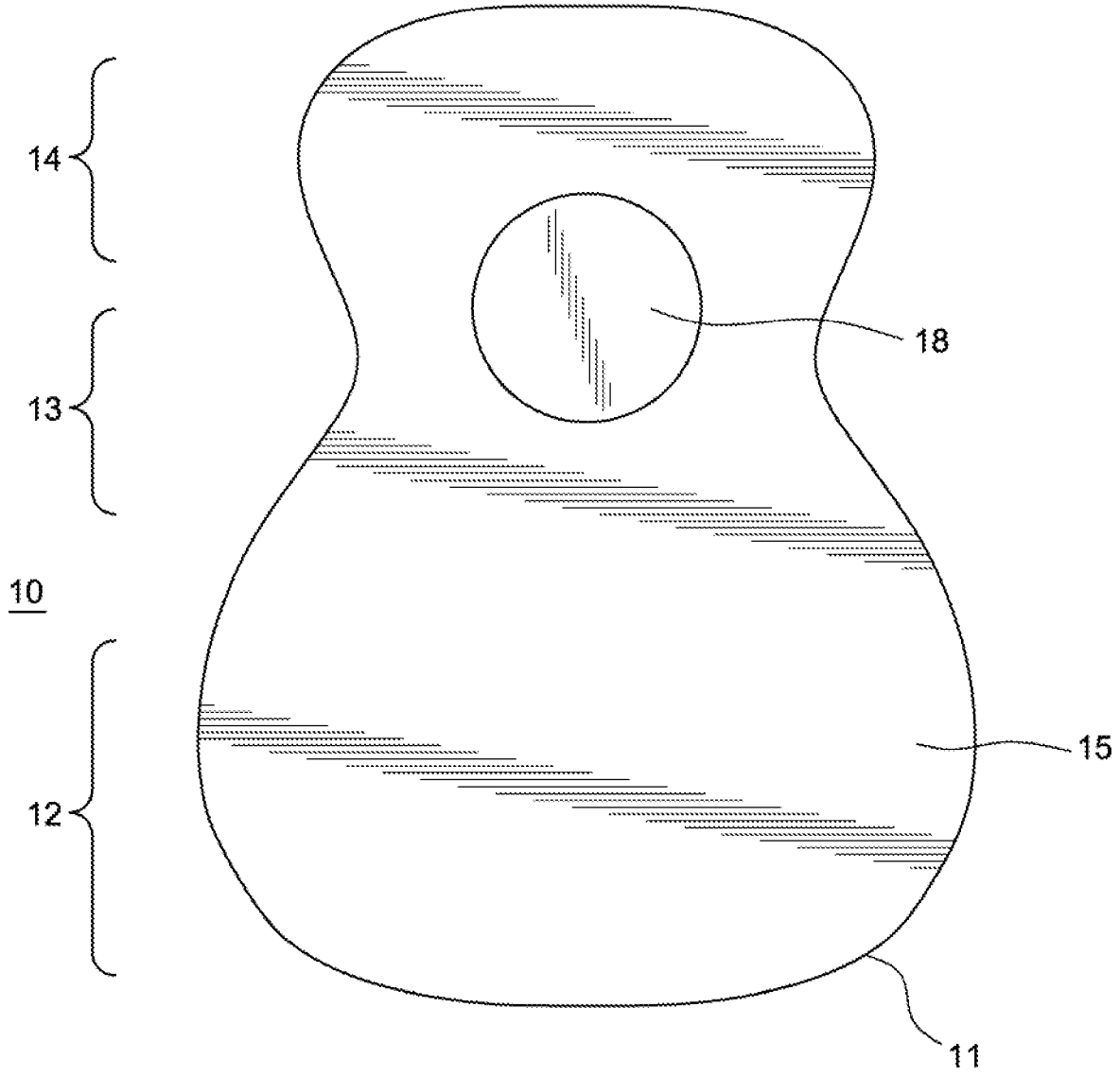
FIG. 1 is a diagram of a percussion instrument with a plurality of sound zones according to an exemplary embodiment.

FIG. 1 is a diagram of a percussion instrument with a plurality of sound zones according to an exemplary embodiment. As shown in FIG. 1, the percussion instrument 10 includes a guitar shaped main body 11, an upper surface soundboard 15, and a sound hole 18 within the soundboard 15. The main body 11 is hollow and includes a treble or upper bout portion 14, a bass or lower bout portion 12, and a waist portion 13 positioned in-between the upper and lower bout portions 12 and 14. The combination of differently sized lower and upper bout portions 12 and 14 and the waist portion 13 contribute to the creation of a variety of different sound zones that are close at hand to one another across the percussion instrument 10. The upper bout portion 14 generally providing a higher range of sound frequencies while the lower bout portion 12 generally providing a lower range of sound frequencies. As with a traditional guitar, the compact and ergonomic shape of the main body 11 allows it to be worn on a musician's body using only a strap while providing unprecedented mobility. Moreover, existing industry-standard methods of manufacturing traditional guitars may be drawn from to manufacture the guitar shaped percussion instrument 10 of the present invention.

While the main body of the exemplary embodiment is guitar shaped, other main body shapes and sizes may be used while remaining portable and within the scope of the present disclosure, each shape providing a variety of high tones, low tones, and unique tonal characteristics across the surface of the main body.

Returning to FIG. 1, the sound hole 18 has a circular shape and is generally positioned within the waist portion 13 of the soundboard 15. While the sound hole of the exemplary embodiment is circular shaped and generally positioned within the waist portion, other sound hole shapes and other sound hole positions in other portions may be implemented while remaining within the scope of the present disclosure. Moreover, while the exemplary embodiment shows a single sound hole within the upper surface soundboard, the sound hole may be comprised of several individual holes of varying shapes and sizes positioned across the upper surface soundboard or any other surface comprising the main body.

The main body may be made of the same wood as traditional guitars or may be made of other material know to one or ordinary skill in the art including particle board, composites, plastic, or other materials.

Figure 2:
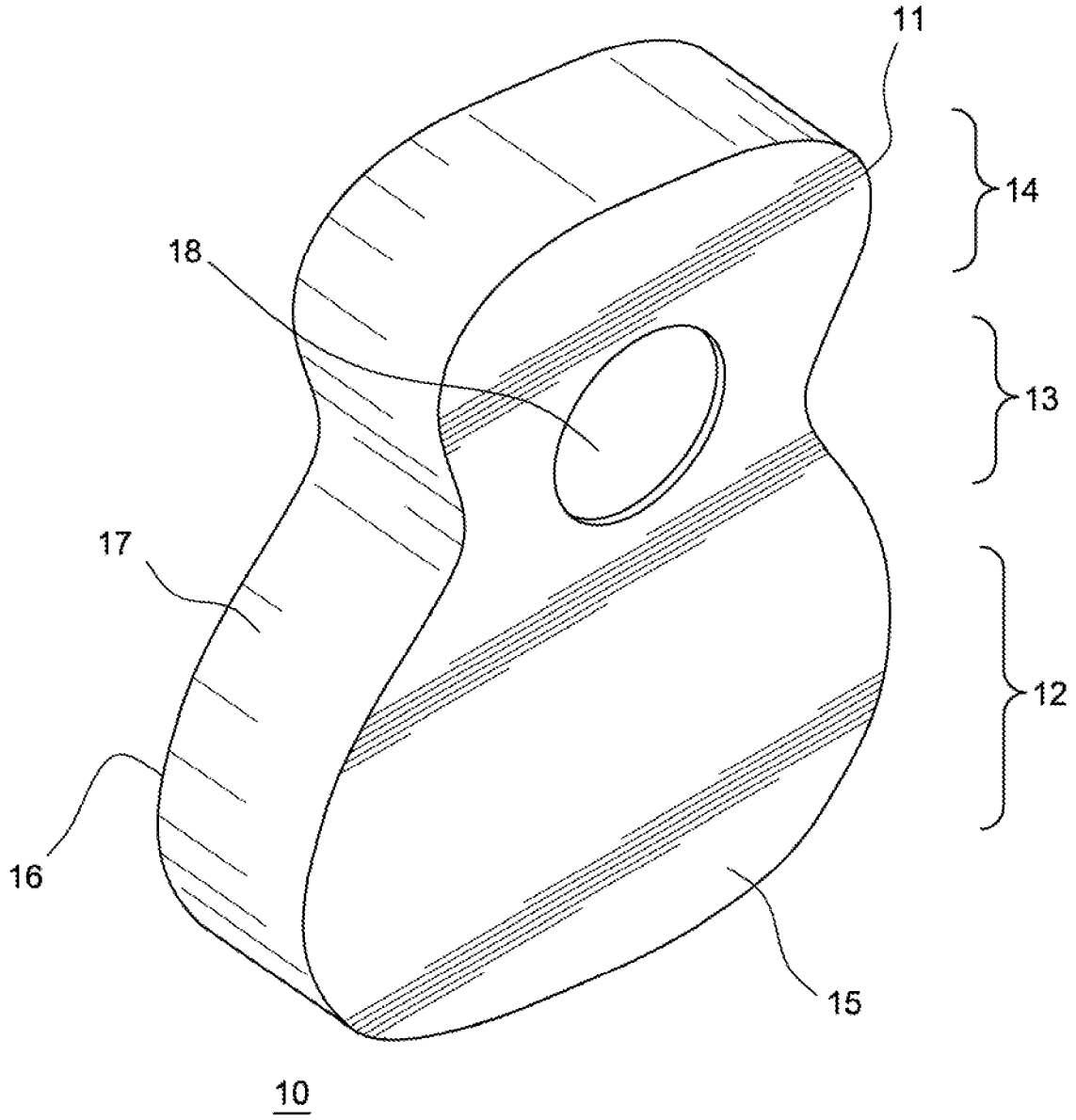
FIG. 2 is a perspective view of a percussion instrument with a plurality of sound zones according to an exemplary embodiment.

FIG. 2 is a perspective view of a percussion instrument with a plurality of sound zones according to an exemplary embodiment. As shown in FIG. 2, the guitar shaped percussion instrument 10 includes an enclosed area defined by the upper soundboard surface 15, a lower board 16, and body sides 17. The shape and dimensions of the lower board 16 are identically to that of the upper soundboard 15. The body sides 17 are attached along the full perimeters of the upper soundboard 15 and the lower board 16 thereby creating an enclosed space within the main body 11 with a defined depth.

While the lower board of the exemplary embodiment is shown as identically shaped and sized to the upper soundboard, the lower board may differ in shape and size from the upper soundboard while remaining within the scope of the present disclosure. The lower board, irrespective of shape and size, interacts with the side walls and the upper soundboard to define an enclosed space within the main body.

Figure 3:
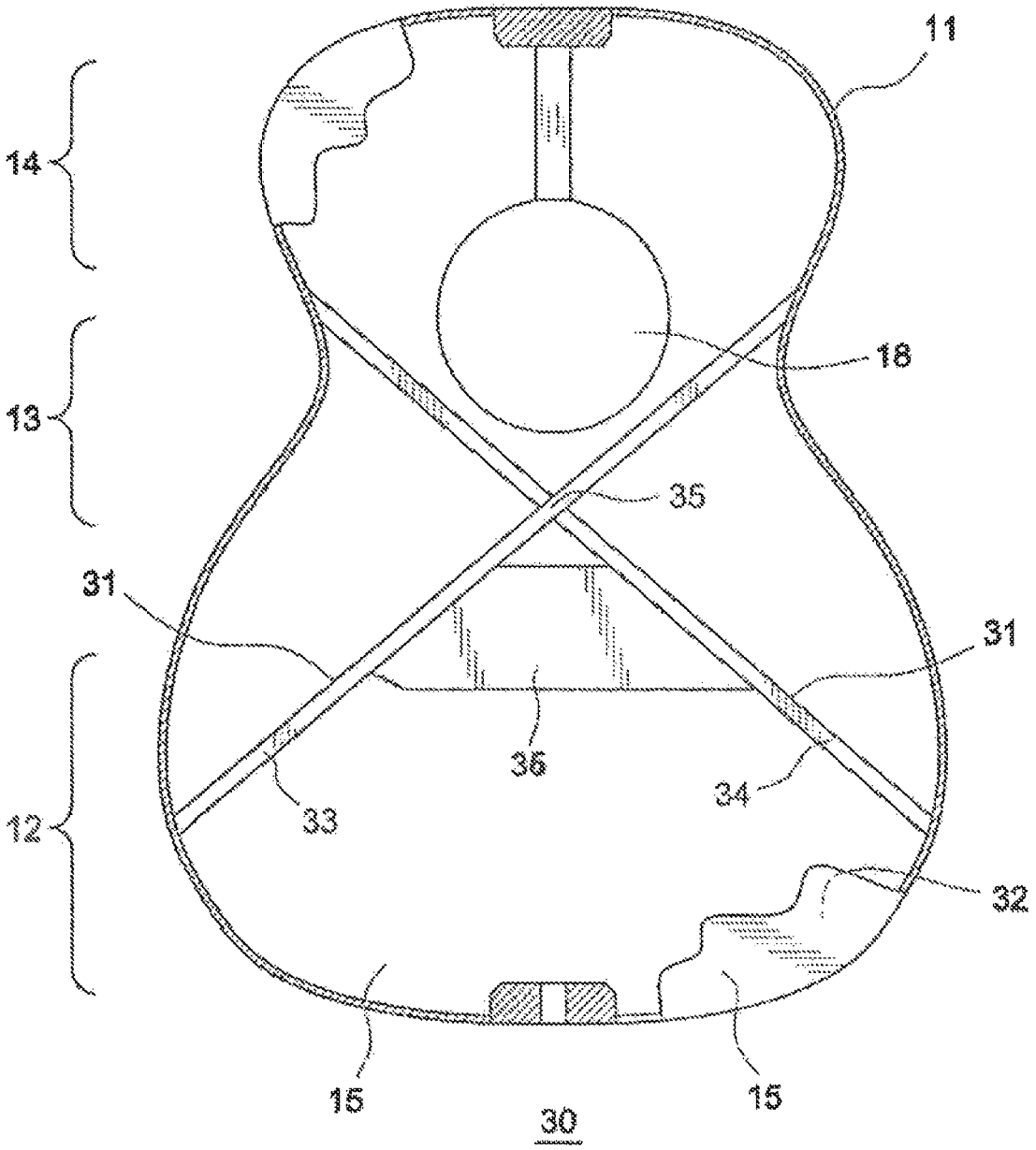
FIG. 3 is a detailed diagram of a percussion instrument with a plurality of sound zones showing its internal bracing according to the exemplary embodiment.

FIG. 3 is a detailed diagram of a percussion instrument with a plurality of sound zones showing its internal bracing according to the exemplary embodiment. As shown in FIG. 3, the internal bracing 30 is comprised of a cross brace 31 generally spanning across the lower bout and waist portions 12 and 13 of the main body 11.

In the exemplary embodiment, the cross brace 31 is comprised of a pair of identical bracing bars 33 and 34 mounted directly onto an inner face 32 of the soundboard 15 and positioned to overlap each other at a single intersection point 35. Each mounted bracing bar functions to dampen the vibration of the soundboard 15 along the line where in comes in direct contact with the inner face 32 of the soundboard 15, leaving the neighboring portions of the soundboard free to vibrate separately. These mounted bracing bars 33 and 34 have the effect of creating independent sound zones across the soundboard 15 surface, each sound zone loosely defined by its respective bordering cross bars 33 and 34. The acoustical characteristics of each defined sound zone being directly dependent on the size and shape of the surface area defined by the cross bars 33 and 34 bordering that sound zone's portion of the soundboard 15.

While the internal bracing in the exemplary embodiment is shown as a cross brace, other internal bracing configurations are within the scope of the present disclosure. Specifically, individual bracing bars may be shaped, sized, and positioned in a variety of ways in order to create one or more sound zones across the soundboard with specific and custom acoustical characteristics. Moreover, while the internal bracing is shown mounted to the inner face of the soundboard, it may also or alternatively be mounted to an inner face of the lower board thereby creating individual sound zones across the lower board.

Returning to FIG. 3, the internal bracing within the main body also includes a bridge plate 36 mounted directly onto the inner face 32 of the soundboard 15. The bridge plate 36 may be used to mount an electronic pickup within the main body 11. As shown in FIG. 3, the bridge plate 36 is disposed in the lower bout portion between said bracing bars 33, 34 of cross brace 31 and below the intersection point 35.

Figure 4:
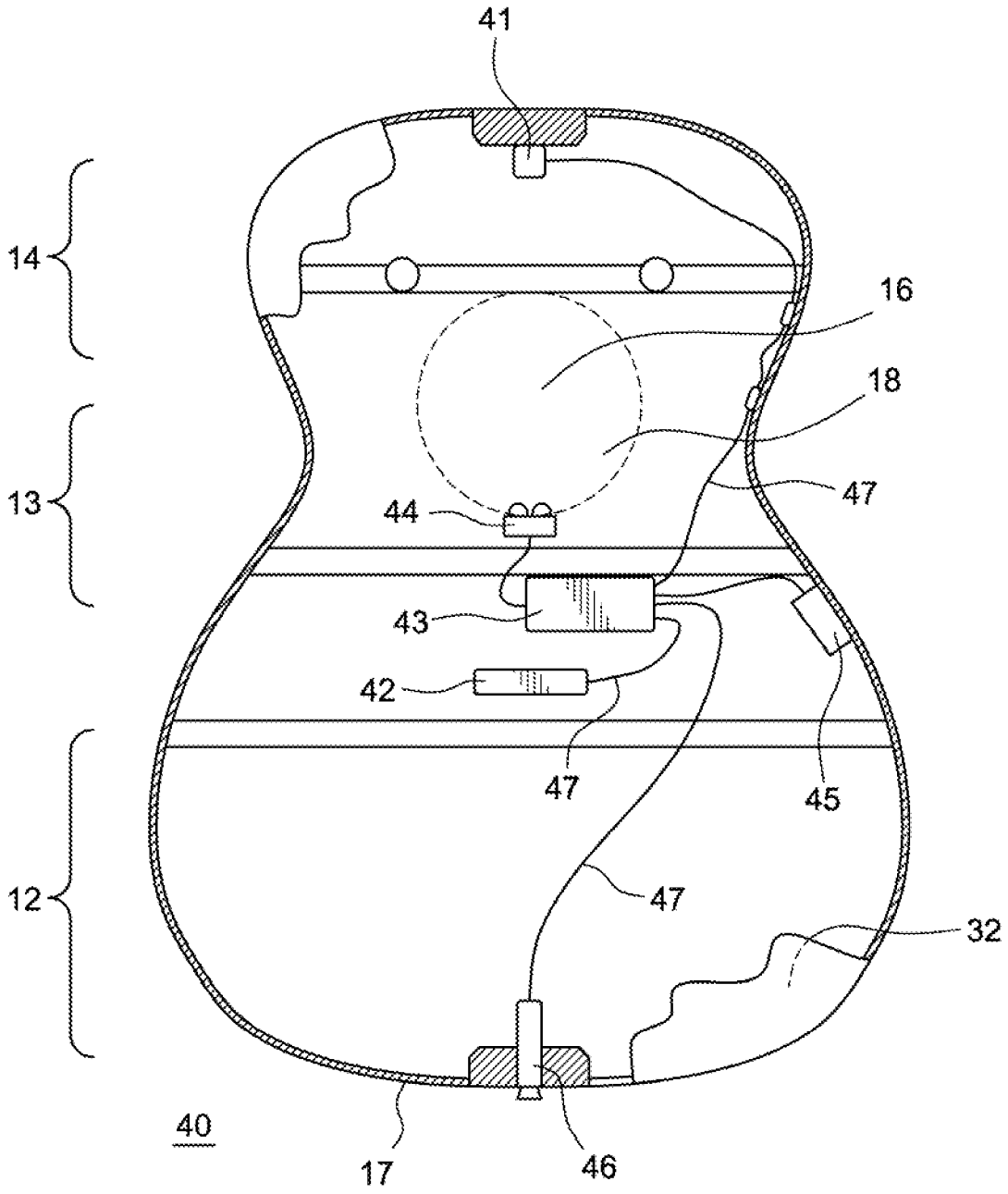
FIG. 4 is a detailed diagram of a percussion instrument with a plurality of sound zones showing its internal amplification system according to the exemplary embodiment.

FIG. 4 is a detailed diagram of a percussion instrument with a plurality of sound zones showing its internal amplification system according to the exemplary embodiment. As shown in FIG. 4, the amplification system 40 includes both a microphone 41 and an electronic pickup 42, each including all necessary accompanying electronics and wiring as know you one of ordinary skill in the art.

The microphone 41 is mounted to the inner face 32 of the soundboard 15 within the upper bout portion 14 and is positioned to have its pickup face downward towards the lower board 16. The microphone 41 is designed to respond to sound waves travelling through the air encompassed within the main body 11. Moreover, the microphone 41 is tuned to be responsive and output a first source audio signal that is maximized in response to treble frequency sound waves, namely sound waves above 1 kHz. The microphone 41 is preferably positioned within the upper bout portion 14 of the main body 11 which is designed and shaped to generate treble frequency sound waves.

The electronic pickup 42 is mounted to the bridge plate 6 within the lower bout portion 12 of the main body 11. The electronic pickup 42 is designed to respond to vibrations on the soundboard 15 itself. Moreover, the electronic pickup 42 is tuned to be responsive and output a second source audio signal that is maximized in response to bass frequency vibrations, namely vibrations below 1 kHz. The electronic pickup 42 is preferably positioned within the lower bout portion 12 of the main body 11 which designed to generate bass frequency vibrations.

The first source audio signal originating from the microphone 41 and the second source audio signal originating from the electronic pickup 42 are each routed via standard cabling 47 to the inputs of an audio processor 43 mounted to the inner surface of the lower board 16 within the main body 11. The output of the audio processor 43 is routed via the standard cabling 47 to a pickup barrel 46 mounted within a side wall 17 of the main body 11, the pickup barrel 46 providing external access to the audio output of the processor 43.

The audio output of the audio processor 43 is controlled via volume and balance controls 44 mounted near the sound hole 18, the sound hole providing easy access to these controls. The volume control adjusts the amplitude of the audio signal output of the audio processor 43. The balance control adjusting the balance of the first and second source audio signals comprising the audio output signal of the audio processor 43, one extreme resulting in an audio output signal comprised solely of the first source audio signal while the other extreme resulting in an audio output signal comprised solely of the second source audio signal.

An electrical battery source 45 may also be connected to the audio processor 43 via the standard cabling 47. The audio processor may also provide any known audio processing and filtering known to one of ordinary skill in the art.

Figure 5:
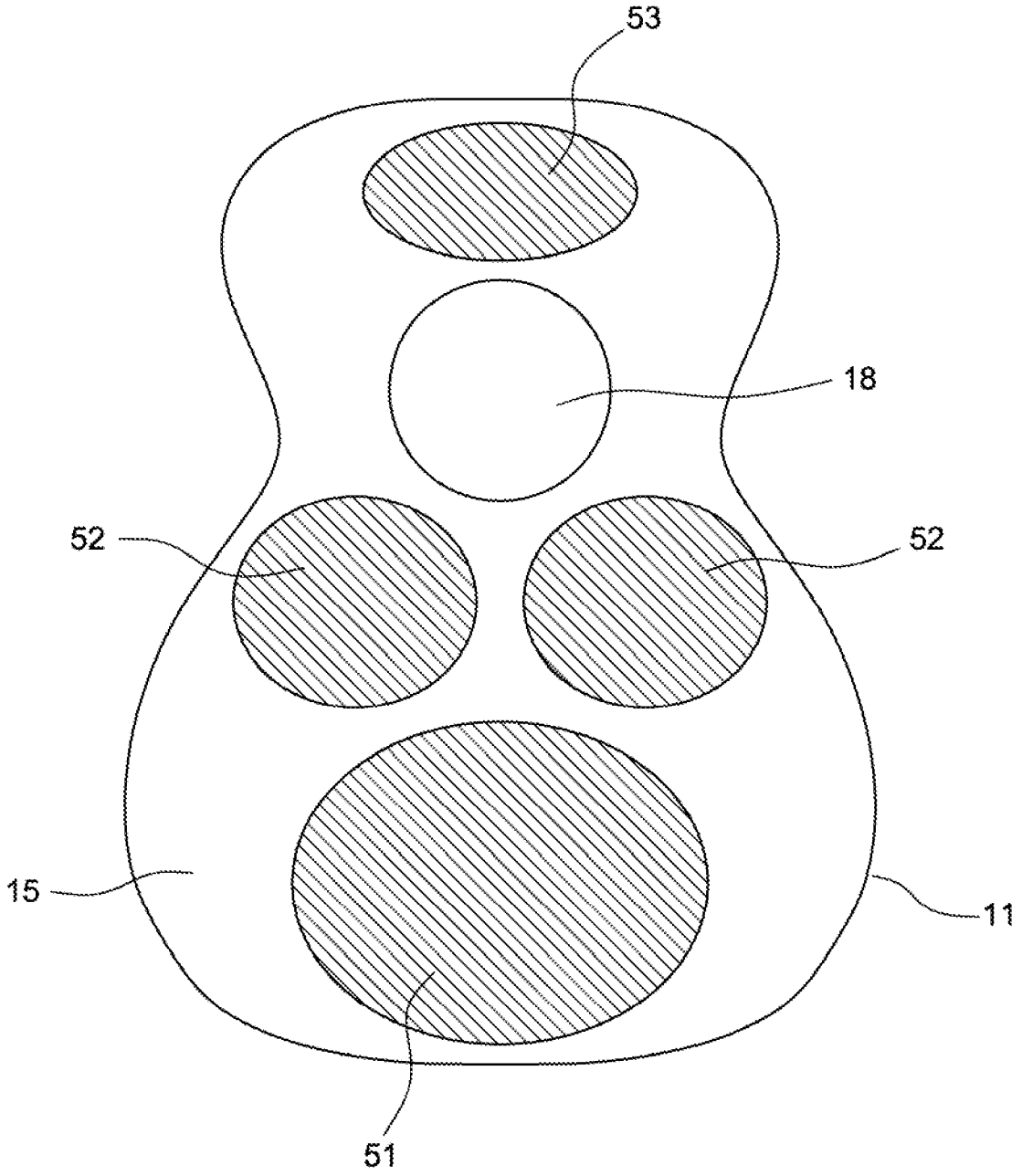
FIG. 5 is a detailed diagram of a percussion instrument with a plurality of sound zones showing its discreet sound zones according to the exemplary embodiment.

FIG. 5 is a detailed diagram of a percussion instrument with a plurality of sound zones showing its discreet sound zones according to the exemplary embodiment. As shown in FIG. 5, the soundboard includes a plurality of individual sound zones defined by the above-described internal bracing 31, these sound zones including a lower bout sound zone 51, an upper bout sound zone 53, and two waist sound zones 52. Each of the individual sound zones 51, 52, and 53 having different tonal characteristics as a result, at least, of their differing surface areas across the soundboard 15. Each of the sound zones are easily accessible across the soundboard 15 of the main body 11.

What is claimed:

1. A percussion instrument with a plurality of sound zones, comprising:

a main percussion instrument body defining an inner space containing a volume of air, the main percussion instrument body including an upper surface and a lower surface that are joined along their perimeters by a side wall, said main percussion instrument body having an upper bout portion, a lower bout portion and a waist portion, said waist portion disposed between the upper bout portion and the lower bout portion, the upper surface including a sound hole and functioning as a soundboard, said sound hole is disposed in the waist portion;

an inner bracing attached directly to ata inner face of the soundboard, the inner bracing comprising bracing bars and a bridge plate, said bracing bars spanning across the lower bout portion and the waist portion, said bracing bars configured to define a plurality of sound zones across the soundboard, each sound zone having a specific tonal quality related to the surface area comprising the sound zone, said bridge plate disposed in the lower bout portion between said bracing bars; and a microphone, said microphone mounted to the inner face of the soundboard within the upper bout portion of the main percussion instrument body.

2. The percussion instrument with a plurality of sound zones of claim 1, wherein the microphone generates a first source audio signal in response to movement within the volume of air.

3. The percussion instrument with a plurality of sound zones of claim 2 wherein the microphone is tuned such that the first source audio signal is maximized in response to treble frequency sound waves.

4. The percussion instrument with a plurality of sound zones of claim 2 further including an electronic pickup mounted to the inner face and generating a second source audio signal in response to vibrations along the soundboard itself.

5. The percussion instrument with a plurality of sound zones of claim 4 is tuned such that the second source audio signal is maximized in response to bass frequency vibrations.

6. The percussion instrument with a plurality of sound zones of claim 4 wherein the electronic pickup is mounted onto the bridge plate attached to and in direct contact with the soundboard, wherein said bridge plate is within the lower bout portion of the main percussion instrument body.

7. The percussion instrument with a plurality of sound zones of claim 4 further including an audio processor mounted to the lower surface within the main percussion instrument body, the processor processing the first and second source audio signals and generating an audio output signal.

8. The percussion instrument with a plurality of sound zones of claim 7 further including volume and balance controls.

9. The percussion instrument with a plurality of sound zones of claim 7 wherein the audio processor includes audio filtering, enhancement, and processor functionality that is performed on the either or both of the first and second source audio signals.

10. A percussion instrument with a plurality of sound zones, comprising:

a main percussion instrument body defining an inner space containing a volume of air, the main percussion instrument body including an upper surface and a lower surface that are joined along their perimeters by a side wall, said main percussion instrument body having an upper bout portion, a lower bout portion and a waist portion, said waist portion disposed between the upper bout portion and the lower bout portion, the upper surface including a sound hole and functioning as a soundboard, said sound hole is disposed in the waist portion;

an inner bracing attached directly to an inner face of the soundboard, the inner bracing comprising bracing bars and a bridge plate, said bracing bars spanning across the lower bout portion and the waist portion, said bracing bars configured to define a plurality of sound zones across the soundboard, each sound zone having a specific tonal quality related to the surface area comprising the sound zone, wherein said bridge plate is disposed in the lower bout portion between said bracing bars;

a pickup, said pickup mounted on the bridge plate; and a microphone, said microphone mounted to the inner face of the soundboard within the upper bout portion of the main percussion instrument body.

11. A percussion instrument with a plurality of sound zones, comprising:

a main percussion instrument body defining an inner space containing a volume of air, the main percussion instrument body including an upper surface and a lower surface that are joined along their perimeters by a side wall, said main percussion instrument body having an upper bout portion, a lower bout portion and a waist portion, said waist portion disposed between the upper bout portion and the lower bout portion, the upper surface including a sound hole and functioning as a soundboard, said sound hole is disposed in the waist portion;

an inner bracing attached directly to an inner face of the soundboard, the inner bracing comprising a cross brace and a bridge plate, said cross brace comprising bracing bars overlapping at an intersection point, said cross brace spanning across the lower bout portion and the waist portion, said cross brace configured to define a plurality of sound zones across the soundboard, each sound zone having a specific tonal quality related to the surface area comprising the sound zone, wherein said bridge plate is disposed in the lower bout portion between said bracing bars and below the intersection point; and a pickup, said pickup mounted on the bridge plate.

* * * * *